US005411044A

United States Patent [19]

Andolfi

[11] Patent Number: 5,411,044

[45] Date of Patent: May 2, 1995

[54] PATIENT TRANSFER WALKER

[76] Inventor: Alexander S. Andolfi, 17 Sharon Ave., East Setauket, N.Y. 11733

[21] Appl. No.: 226,506

[22] Filed: Apr. 12, 1994

[51] Int. Cl.[6] ..... A45B 3/00

[52] U.S. Cl. ..... 135/66; 135/67; 135/75; 601/5; 280/87.05; 5/86.1; 414/921

[58] Field of Search ..... 135/66, 67, 69, 70, 135/72, 75, 73; 280/304.1, 250.1, 87.05; 601/5, 23, 24; 5/86.1, 81.1, 83.1; 414/921

[56] References Cited

U.S. PATENT DOCUMENTS

| | | | |
|---|---|---|---|
| 2,792,052 | 5/1957 | Johannesen | 5/83.1 X |
| 3,189,345 | 6/1965 | Simpson | 272/70.4 |
| 3,374,493 | 3/1968 | Herrera | 5/86 |
| 3,596,298 | 8/1971 | Durst, Jr. | 5/81 |
| 3,629,880 | 12/1971 | Van Rhym | 5/86 |
| 4,054,319 | 10/1977 | Fogg et al. | 297/384 |
| 4,248,256 | 2/1981 | Thomas | 135/67 |
| 4,390,076 | 6/1983 | Wier et al. | 280/304.1 X |
| 4,443,902 | 4/1984 | Baer | 5/81 |
| 4,598,944 | 7/1986 | Meyer et al. | 280/304.1 X |
| 4,704,709 | 11/1987 | Slebzak et al. | 367/158 |
| 4,704,749 | 11/1987 | Aubert | 5/81 |
| 4,748,994 | 6/1988 | Schultz et al. | 135/67 |
| 4,802,542 | 2/1989 | Houston et al. | 180/65.5 |
| 4,809,804 | 3/1989 | Houston et al. | 180/65.6 |
| 4,985,947 | 1/1991 | Ethridge | 5/81 |
| 5,040,556 | 8/1991 | Raines | 135/67 |
| 5,117,516 | 6/1992 | Penner | 5/86 |

FOREIGN PATENT DOCUMENTS

| | | | |
|---|---|---|---|
| 345114 | 4/1960 | Switzerland | 135/67 |
| 1078758 | 8/1967 | United Kingdom | 5/86.1 |

OTHER PUBLICATIONS

The Arjo-Century Lift Ride Chair, Arjo-Century, Inc., Morton Grove, Illinois 60053, undated.

Stand-Aid of Iowa, Inc.-advertisement.

Motion Systems Corp.-Ball Drive Actuator 85151/85152 Undated-advertisement.

*Primary Examiner*—Lanna Mai

*Attorney, Agent, or Firm*—Alfred M Walker

[57] ABSTRACT

A walker for a handicapped person has a pair of base rails juxtaposed, and a pair of front posts extend therefrom. Each front post is attached to a front of a respective rail. A first pair of rotation-changeable motors drives a pair of actuators, initially pointing upwardly. A first pair of gear reduction devices, which in combination with a pair of rear posts, can be rendered tiltable, has respective input shafts coupled to respective output shafts of the motors. The pair of tiltable rear posts are extendable or retractable by rotation-sense selection of the first pair of motors. A pair of crutch supports are in contact with the rear posts, Which fit under the armpits of the handicapped person. A pair of levers which extend outwardly and downwardly from the pair of crutch supports, respectively, are bent rearwardly, and equipped with handles. A second pair of rotation-changeable motors are attached to the pair of front posts, respectively, and a second pair of length-adjustable gear-reduction mechanisms are coupled to the second pair of motors, and also to the pair of the rear posts, respectively, so as to be operative, upon length adjustment, between forward-and rearward-positions. A switch is connected to the first and second pairs of motors for separate selection of the height and inclination of the rear posts, respectively, by selective choice of the motor's sense-of-rotation and travel.

16 Claims, 12 Drawing Sheets

FIG.5.
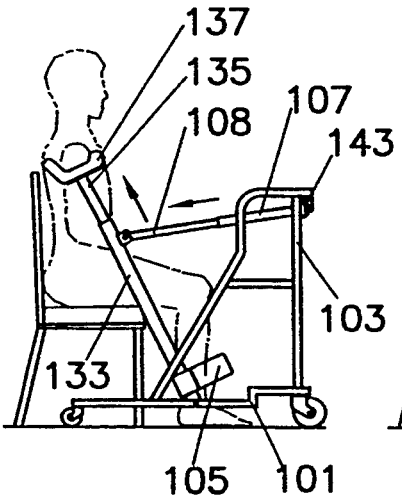
FIG.6.
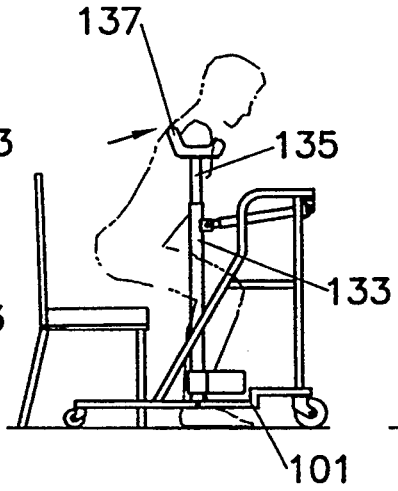
FIG.7.
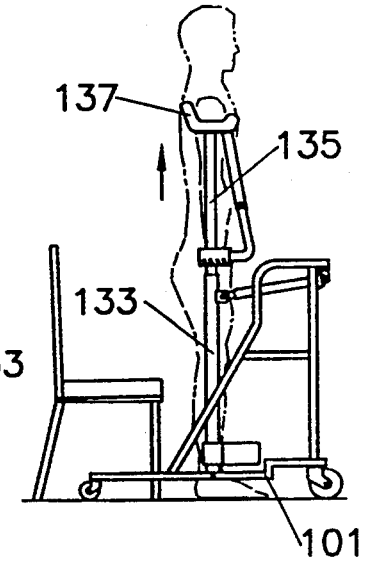
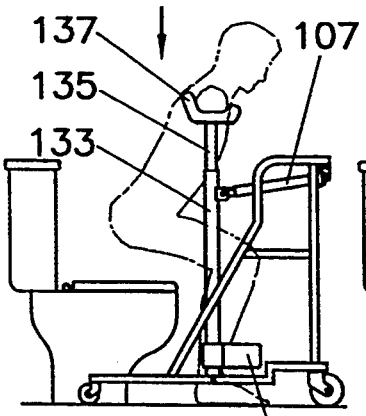
FIG.8.
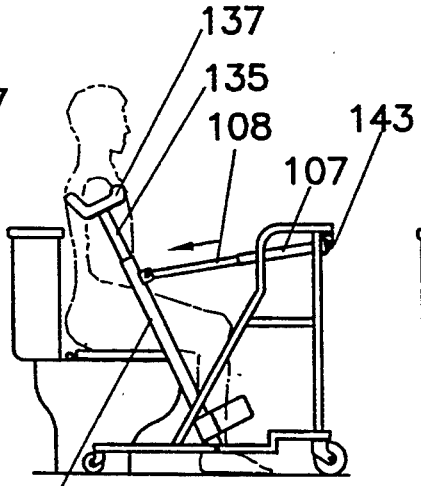
FIG.9.
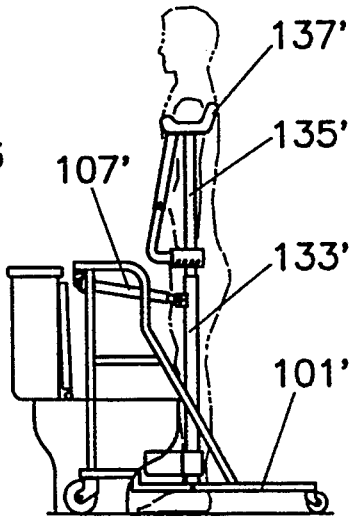
FIG.10.

FIG.11.
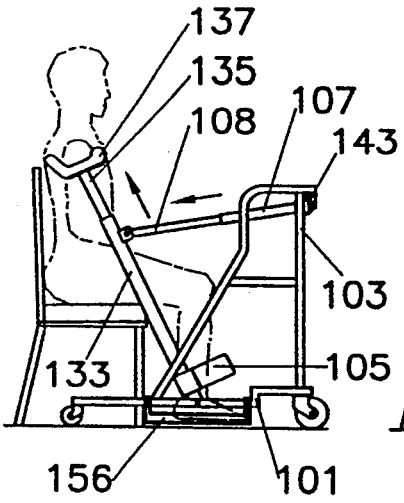
FIG.12.
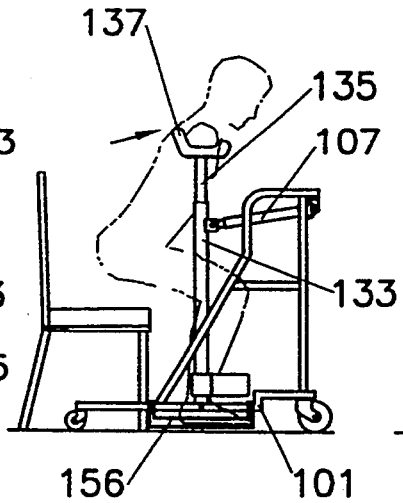
FIG.13.
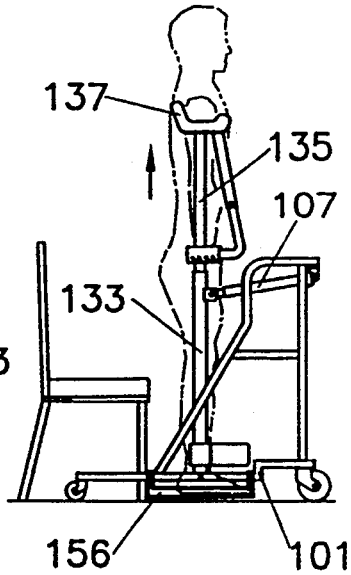
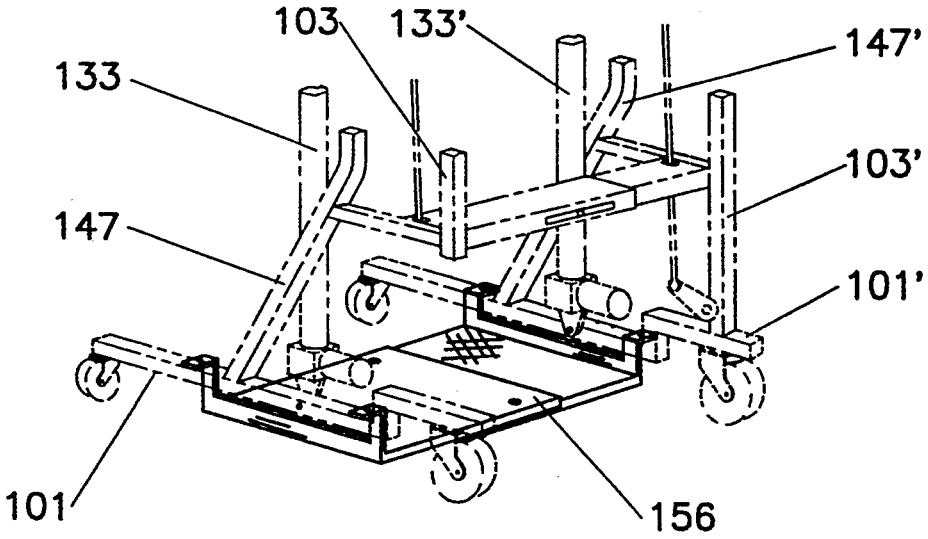
FIG.14.

109
109'

17A
109
109'
17A
143a
143
143c
107
108
135
133
144
143b
143d
109d
109b
109c
109a

PATIENT TRANSFER WALKER

FIELD OF THE INVENTION

The present invention relates to a patient lifting mechanism which ergonomically lifts a handicapped patient upward and outward from a seated to a Standing position in a natural fashion which closely simulates the normal art of getting up from a Chair, and vice versa.

RELATION TO OTHER APPLICATIONS

The present invention was initially disclosed in disclosure document no. 306690, filed Apr. 27, 1992, and supplemented with a follow-up disclosure document no. 338015, filed in the United States Patent Office on Aug. 16, 1993.

DESCRIPTION OF THE PRIOR ART

Lift Ride Chair. The Arjo-Century Lift Ride chair is described in an "Arjo" commercial brochure; although the aforesaid brochure states that the Arjo-Century Lift Ride chair is protected by patents, no patent numbers are given. The brochure designates the chair as a versatile patient lift appropriate for institutional or home use. It is stated that the lift ride chair with a sling enables one person to lift patients from bed, toilet, chair, wheelchair or the floor without manual lifting. In the normal position of its chassis, the lift ride chair fits through any standard doorway, but can be widened for easy transfer from chair to wheelchair. The chair has fold-out chassis legs and brakes on two casters. The lifting range is variable to allow the handling of both tall and short patients. The back belt, equipped with self-locking cords, takes care of both heavy and light patients; it is easy to remove, and is machine washable. The chair handles a load up to 350 lbs. It is manufactured by Arjo-Century, of 6389 Oakton Street, Morton Grove, Ill. 60053.

A device for physically challenged individuals to help them lead a more active, healthy, and participating life, is called Stand-Aid, and is manufactured by Stand-Aid of Iowa, Inc. of 1009, 2nd Ave., P.O. Box 386, Sheldon, Iowa 51201. It is a wheelchair with a hand-operated hydraulic lift, which enables a user to change easily from a wheelchair into a standing position Its height is 38 ½", its width 26 ¾"×32", and it is provided with a 12"×20 ½" plexiglass table, which is adjustable up, down, in and out. The Stand-Aid is capable of accommodating persons from 4'2" to 7'; adjustable knee pads and foot straps are provided, as well as an optional sling, and two ½" caster wheels for transport. The lift feature is operated by one two-ton hydraulic jack, and the lift arms are adjustable for body height. The brochure is silent on patent protection.

Aubert, U.S. Pat. No. 4,704,749, filed May 23, 1986 on application Ser. No. 866,535, issued Nov. 10, 1987, relates to a body lift and walker for paralytics. The body lift has a wheeled frame and drive motor for moving the frame on its wheels. A vertical support extends upwards from a base of the wheeled frame, and arm and leg supports are movably mounted for translation along the vertical support. The leg support of the leg support pair are laterally pivotable toward and away from each other.

A torsion spring is connected to urge the leg supports to a normally outwardly pivoted position, and arm supports of the arm support pair are coupled to pivot the leg supports inward laterally in response to weight applied by a user to the arm supports. A control engagable by the user is connected to the motors to allow the user to move the lift on its wheels, and casters, and to adjust the height of the arm and leg support pairs.

Slebzak et al, U.S. Pat. No. 4,704,709, filed Jul. 12, 1985 on application Ser. No. 754,50, and issued on Nov. 3, 1987, relates to a transducer assembly with explosive shock protection. It uses a Tonpilz transducer having head and tail masses with an interposed active transducer section. The transducer unit is positioned within a housing, which has a shoulder portion, upon which, in turn, rests a snubber member, which extends to a position just behind the head mass. The transducer is supported from the head mass by means of a thin fiberglass tube, which extends from the rear of the head mass, and engages a flange portion of the snubber member in the vicinity of the housing shoulder. The housing has a waterproof covering, as does the head member, with the covering of the headmember being secured to the covering by means of a removable strap, such that the transducer assembly may be disassembled for repair.

Houston et al relate to a powered walker filed on application Ser. No. 899,890 on Aug. 25, 1986, which has matured into U.S. Pat. No. 4,802,542. The powered walker includes a frame assembly defining a central space for containing an operator in a standing position. A mechanism is included for selectively moving the apparatus over a ground surface. A gate is provided for closing an entryway into the central space, and is adapted to define the front surface of the apparatus, when in the closed position. Finally a seat arrangement is provided having a seat member movable between a substantially horizontal position within the central space, wherein the operator is maintained in a sitting position, and a substantially vertical position, wherein the operator is maintained in a standing position within such a central space.

Ethridge, on application Ser. No. 522,670, filed May 14, 1990, which has matured into U.S. Pat. No. 4,985,947 relates to a machine for assisting a partially ambulatory user to rise and move about. The wheeled frame comprises a rigid, U-shaped based which supports a pair of upwardly extending sides. The frame sides border an open front, in which the user is received. Rigid handrails associated with the frame sides, and a push handle associated with the frame rear may be grasped by the user for support.

A cushioned yoke engages the user's torso to support body weight. The yoke may be interchanged with a custom yoke, which conforms to the user's body. The yoke is pivotally coupled to a winch-driven linkage assembly, comprising a pair of cooperating levers mounted for movement within the frame interior. The top and bottom levers pivot about pivot points defined by bearings coupled to the frame sides. The levers are of different lengths, and their pivot points are offset, so that the camber of the yoke varies during operation. The linkage assembly is driven by a battery-powered winch. Electrical switches associated with the yoke or the hand rails are conveniently accessed by the user to activate the winch. As the user rises from a seated position, the yoke undergoes camber loss until it reaches an intermediate position of maximum negative camber. Camber gain occurs as the yoke rises to its uppermost position of maximum positive camber. The user is thus comfortably and positively supported.

Simpson, on application Ser. No. 227,882 filed on Oct. 2, 1962, which matured into U.S. Pat. No. 3,189,345 on Jun. 15, 1965, relates to walking assist and lifting device for supporting exercising, lifting and transferring from one place to another incapacitated or handicapped persons, who do not have complete use of their limbs or muscles.

The lifting and supporting device comprises a wheeled supporting frame, a housing mounted on the supporting frame, a pair of vertically spaced means transversely journaled in the housing for rotation, vertically spaced pairs of parallel support arms connected in opposite ends of the pair of transversely journaled means for movement therewith, and extending forwardly of the housing, supporting means carried by, and pivoted to the terminating ends of each vertically spaced pair of parallel support arms for engaging the user, gearing disposed in the housing, mutually and rotatively intersecting the pair of transversely journaled means of the vertically spaced pairs of parallel supports arms, and means connected with the gearing for imparting rotating lifting forces thereto, so as to adjust the elevation of the supporting means and the support arms, whereby the gearing mutually distributes the rotating lifting forces equally between the pair of transversely journaled means, and the upper and lower arms of the spaced pairs of parallel support arms.

Raines, on application Ser. No. 632,940 filed on Dec. 24, 1990, which matured into U.S. Pat. No. 5,040,556, relates to a walker for a handicapped and convalescent person, which is provided with, and consists of a pivotally segmented top rail member, a pivotally segmented larger base member, with a plurality of ground-engaging casters, and a plurality of legs between the top rail member and the base member. The top rail member and the base member are locked after the person has entered the improved walker, so that the person can grip the top rail member for support, and move the improved walker along the ground with his/her hands free. A seat, made of flexible material, is attached to the top rail member, so as to drape and pass between the legs of the person, so that the person can sit thereon, while the larger base member will help keep stability thereto, and prevent the improved walker from falling over.

Herrera, on application Ser. No. 582,450, filed on Sep. 22, 1966, and which matured into U.S. Pat. No. 3,374,493, relates to devices, especially useful for persons who, as a result of illness, injury or other reasons, are unable to stand, walk, or sit down without assistance. The invalid lifting device comprises (a) a framework including a pair of L-shaped tubes, each having a horizontal rail portion and a vertical rail portion upstanding from the forward end of the rail portion.

The framework further includes a plurality of ground-engaging casters mounted thereon, (b) a pair of rearwardly extending arms pivotally mounted on the posts for swinging movement in a vertical plane, (c) a pair of arm-pit supporting members on the after-ends of the arms, (d) hydraulic means for moving the arms between a first lower position of the arm pit supporting members, and a second elevated position thereof, (e) a seat sling mounted on, and depending from the after end of the arms, (f) a control valve located within the reach of a person supported above the sling, (h) a hydraulic piston and cylinder, forming a part of the hydraulic means, and being pivotally connected to one of the arms and to one of the tubes, at least one of the tubes forming a reservoir for the hydraulic fluid used in conjunction with the hydraulic arm moving means, (i) adjustable spacer means connecting the arms, and (j) means for pivotally mounting the forward of the arms on the posts for horizontal swinging movement of the arms in dependence upon the position of the spacer means.

Van Rhym, on application Ser. No. 885,965, filed on Sep. 8, 1969, which matured into U.S. Pat. No. 3,629,880 teaches an apparatus for assisting invalids.

Van Rhym's invention relates to an apparatus for assisting a user thereof, particularly a person who has some disabilities in his legs, to stand, and comprises a framework incorporation a raisable seat member adapted to support the seat of the user, means for raising the seat member, and a knee support adapted to engage, at about knee height, with the legs of the user.

Durst, on application Ser. No. 824,630, filed on May 14, 1969, which on Aug. 3, 1971 matured into U.S. Pat. No. 3,596,298, relates to a lifting apparatus adaptable for aiding an ambulatory handicapped person. The apparatus may accommodate a person between a sitting position and a standing position. The apparatus aids in raising or lowering the individual between two positions. The apparatus includes a pair of arm rests for engaging an individual beneath the junction of the arm and shoulder. The apparatus provides for vertical and lateral movements of the rests. The vertical motion of the rests responds to a first piston means with the start and stop operation directly controlled by the individual.

Fogg Jr. et al, on application Ser. No. 625,220, filed on Oct. 23, 1975, which matured into U.S. Pat. No. 4,054,319 on Oct. 18, 1977, have designed a wheelchair to enable an invalid to stand, sit, or choose at will any intermediate position to perform useful work, and to move about in any of the aforesaid positions. The wheelchair helps to fulfill the psychological and physiological needs of handicapped persons.

The lifting and lowering operations are so arranged that practically no dislocation of the invalids clothes occurs during operations. The wheelchair has a minimum of physical encumbrances, permitting the invalid to function near normally in the average living or working spaces.

Baer, on application Ser. No. 280,211, filed on Jul. 6, 1981, which matured into U.S. Pat. No. 4,443,902 on Apr. 24, 1984, provides for a motorized walker and transfer device, having an armpit lift lever. The lift arms are pivoted to a front stationary crossbar above a wheeled chassis, and the arms are actuated by a motorized gear reduction device, the output of the shaft of which drives a jackscrew and a power tube connected at the opposite end to a transverse tube positioned forward of the first mentioned cross-tube. The lift arms are automatically shifted in a gentle arc.

Houston et al, in application Ser. No. 936,078 filed on Nov. 1986, which matured into U.S. Pat. No. 4,809,804 on Mar. 7, 1989, provide for a wheelchair apparatus, which includes a frame having a base portion, and spaced side portions to define a space for receiving an operator's body. A device is provided for supporting the frame above a ground surface for movement therealong, and includes a mechanism for moving the apparatus over the ground surface. A device is provided to permit an operator within the space to control movement of the apparatus along a ground surface.

Finally, a seat assembly supports and selectively moves an operator between a fully seated position, and a substantially upright position within the apparatus, to permit the operator to control and move the apparatus over the ground surface from both the fully seated position, as well as the substantially upright position.

Penner, in application Ser. No. 797,690 filed on Nov. 15, 1991, and which matured into U.S. Pat. No. 5,117,516 on Jun. 2, 1992, provides means for lifting a handicapped or otherwise disabled person from a sitting position, and moving such person to another area, as for a bath, of a toilet of different seating, comprising an open torso support formed of a rigid transverse member, such member having an inner wall adapted to fit across the person's abdominal area, and a vertical outer wall supporting a pair of vertical elements spaced apart from each other, and having rearwardly extending arcuate arm supports. The torso support is pivotally attached to lifting means, such as a hydraulically constructed "cherry picker" lift, or an overhead lifting cable.

Houston et al, in application Ser. No.899,890, filed on Aug. 25, 1986, and which matured into U.S. Pat. No. 4,802,543 on Feb. 7, 1989, relate to a powered walker apparatus, and include a frame assembly defining a central space for containing an operator in a standing position. A mechanism is included for selectively moving the apparatus over a ground surface.

A gate is provided for closing an entry into the central space, and is adapted to define the front surface of the apparatus, when in a closed position. A seat assembly arrangement is provided having a seat member movable between a substantially horizontal position within the central space, wherein the operator is maintained in a sitting position, and a substantially vertical position, wherein the operator is maintained in a standing position within such a central space.

None of the patents reviewed either anticipate the present invention, or render it obvious in whatever combination of the patents is applied. Although Van Rhym's apparatus for assisting invalids operates crank handles in conjunction with a liftable seat, the non-numbered crank handles are neither motorized, nor employ any length-adjustable and rotatably energizable gear reduction means, and rotatable and tiltable coupling means combined therewith, essential for the present invention. Moreover, the prior art does not describe a patient lifting mechanism with length adjustable gear-reduction mechanisms, attached to the first and second pair of actuators, which move crutch supports attached to rear telescopic posts in respective vertical and horizontal movements, so that the handicapped patient can be moved naturally upward and out from a seated position to a standing position.

In addition, the prior art does not describe a patient transfer walker which includes the use of gear reduction mechanisms, in conjunction with the telescoping posts, where a handicapped person can be gently lifted from a seated position in an arcuate manner, and by reversing this procedure, can be gently moved from a standing position to a sitting position.

OBJECTS OF THE INVENTION

It is therefore an object of the present invention to provide a patient lifter which lifts patients upward and outward at the same time.

It is a further object to provide a patient transfer device which also functions as a patient walker.

It is yet another object to provide a patient walker which is comfortable in use.

It is a further object to provide a patient walker which closely simulates the natural egress of a person from a chair, and a natural way of reversing this process.

It is yet another object of the present invention to provide a patient walker which is an improvement over the prior art.

It is still another object to provide a patient walker, which while equipped with the above listed features, is still collapsible for convenient storage.

SUMMARY OF THE INVENTION

In keeping with these objects and others which will become apparent, the present invention includes a patient transfer walker with telescoping lifting arms for naturally and gently lifting the patient in a natural lifting manner to a standby position which closely approximates the natural process of standing up of a person from an initial seated position.

The patient transfer walker for a handicapped person includes a pair of base rails juxtaposed; a pair of front posts extend therefrom, and each front post is attached to a front portion of a respective rail. A first pair of rotation-changeable motors drives a pair of vertical actuators, and a second pair of rotation-changeable motors drives a second pair of horizontal actuators. A second pair of movable, telescopic rear posts are extendable or retractable by the first and second pairs of actuators, and a pair of crutch supports are in contact with the telescopic rear posts on their undersides at the top of the second pair of posts.

The telescopic rear posts fit under the armpits of the handicapped patient. A pair of levers extend outwardly and downwardly from the pair of crutch supports, are bent rearwardly, and are equipped with handles. Length adjustable gear-reduction mechanisms, attached to the first and second pair of actuators, are operative to move the rear telescopic posts in respective vertical and horizontal movements, so that the handicapped patient can be moved naturally upward and out from a seated position to a standing position.

A key inventive feature is the gear reduction mechanisms, in conjunction with the telescoping posts, where a handicapped person can be gently lifted from a seated position in an arcuate manner, and by reversing this procedure, can be gently moved from a standing position to a sitting position.

The horizontal and vertical reduction gear mechanisms are attached to rotating threaded spindles, which extend from the motors to the telescoping posts.

In the vertical actuators for the telescoping posts, a vertical post is attached to the gear box mechanism. To permit a 28 degree tilt, the gear box has at its bottom a conventional clevis yoke, which straddles the frame bar below it. The clevis yoke and the frame bar have respective bores which extend therethrough so as to permit a pin to constitute a fulcrum, about which the clevis yoke, gear box and post rotate.

In a horizontal actuator for the telescoping posts, a gear box is adjacent to the motor. An extension is attached to the actuator, and is formed with a bore, which fits in a conventional clevis yoke, and which rotates about a pin.

In operation, the patient transfer walker is an electro/mechanical multi-purpose rehabilitation device designed for use in hospitals, nursing homes, or in the home setting. The walker has underarm supports, and swivel casters, allowing the patient to walk around with the aid of the walker in a stabilized manner, with a feeling of security. The walker power-assists then returns the patient to a seated position in a chair, to the bedside, to the toilet or to a wheelchair.

It is primarily designed to be used by the partially ambulatory who have difficulty standing and/or sitting, and specifically for a non-ambulatory population with upper body strength, such as the disabled, handicapped, and geriatric population, the debilitated, those patients with leg and back injuries, and post-operative patients.

The transfer walker has been designed to incorporate an optional removable intravenous feeding support, which can be installed on either side of the walker.

By installing a standing platform at the lower walker frame, non-ambulatory patients can be power lifted, then relocated, on wheels, with the assistance of an attendant.

In addition to transferring patients to the seated toilet position, the device of the present invention has a lower front frame which has been contoured to clear the top of the toilet to accommodate men in a standing-up position.

The device aids in bedsore prevention and treatment, by periodically transferring patients out from bed, which in turn helps relieve bed sore pressure, thus aiding in the healing process.

The patient lifting device of the present invention also functions as an aid for nurses and care givers when dressing patients, thus preventing back injuries otherwise suffered by nurses and care givers when lifting patients manually.

The patient transfer walker of the present invention offers a unique combination of lifting features, with a new innovative power lift concept in the rehabilitation environment.

An advantage of the device of the present invention is that the patient transfer walker is designed to accommodate a large variation in population, height, girth and weight among potential users of the device.

Other advantages of the transfer walker include that it may be used in a variety of settings. It may be stabilized with locking casters and may have optional intravenous feeding accessories; it may be used in male toileting with the patent in a stand up position; as an aid for dressing patients and as a transfer apparatus for non-ambulatory patients.

The patient transfer walker of the present invention is constructed in a "U" shape which surrounds the front and two sides of the patient's body. It includes two halves which allow the width to be adjustable, and get to be collapsible. Both halves are set on four locking type casters with a locking lever linkage. The transfer mechanism includes four individual linear motion actuators. While a lead screw gear motor type may be used; it may alternately be implemented by be another type mechanism with a similar or other function. The transfer mechanisms are arranged in such a way as to form two variable stroke telescopic linkages. Each linkage includes a vertical actuator and a horizontal actuator mounted on each side of the patient walker frame. The horizontal actuator has an extension tube that is connected by a fixedly located pivot at the top of the vertical actuators, and therefore, forming the linkage. The mechanism is powered by use of power source, such as a rechargeable battery and a hand held switch pendent.

The patient is supported under the armpits by crutch supports, which are padded and located at the top of each vertical actuator. The rear end of each crutch support protrudes higher than the front end in order to keep the patient from slipping off the crutch during a transfer. Hand grips are attached to the bottom of the crutch supports, and are adjustable.

An optional intravenous feeding support includes a vertical and horizontal rod constructed in such a way that it will support an intravenous system. The rod may be installed in a socket on either side of the walker frame.

A removable, adjustable foot rest platform is used for non-ambulatory patients. It is located low near the floor and spans the two halves of the lower walker frame.

OPERATION OF THE PATIENT TRANSFER FUNCTION

The transfer walker vertical lift actuators are aligned with the patient's feet while the patient is in a sitting position, with locking casters with a lock lever. The vertical actuators are rotatable towards the patient, by activating the horizontal actuators. The vertical actuators remain activated until the padded crutch supports come in contact with the armpits of the patient. When the horizontal actuators are activated, they pull the patient forward to balanced, quasi-standing or crouched position.

The vertical actuators are then actuated until the patient is elevated to the normal standing height. The horizontal actuators and vertical actuators may be activated simultaneously for a combined motion, which closely simulates the natural movement of a person from a seated position to a standing position.

Sitting is accomplished by reversing the above procedure.

When in the walking mode, the walker frame is supported by four casters. It allows the user to walk about freely with the aid of the walker in any direction, in a stabilized manner, and with the use of the under arm crutch supports and hand grips.

In another standing function for male toileting, the walker has been configured so that the front end of the frame can clear a toilet. This feature has been incorporated to obtain a stand up urinating position for men.

In the intravenous function, the transfer walker incorporates a removable intravenous feeding support that can be in use while the patient is walking about. The support may be installed on either side of the walker frame.

In the transfer-function for non-ambulatory patients, a foot rest platform is removably installed as a floor on the lower walker frame. An attendant then places the patient's feet on the foot rest platform while the patient is in a sitting position. The patient can now be transferred from sitting, to a standing position on the foot rest platform, using the procedures outlined in the aforementioned transfer functions. After the transfer is completed, the patient may be rolled around by an attendant as needed and relocated onto a bed, chair, wheelchair or toilet.

Summing up the invention, the patient transfer walker is an electro/mechanical multi-purpose rehabilitation device used in hospitals, nursing homes, or in the home setting. It gently power-lifts a patient from a sitting to a standing position along an arcuate path. The walker has underarm supports, and swivel casters, and allows the patient to walk around freely with the aid of the walker in a stabilized manner, with a feeling of security. The walker power-assist then repositions the patient to a seated position in a chair, to the bedside, to the toilet or to a wheelchair. It is primarily used by the partially ambulatory, who have difficulty standing and sitting, and specifically for a non-ambulatory population with upper body strength. This includes the disabled, handicapped, and geriatric population, the debilitated, patient with leg and back injuries, and post operative patients.

DESCRIPTION OF THE DRAWINGS

The patient transfer walker, according to the present invention, will be better understood with the aid of the following figures, in which:

FIGS. 5–13 are side elevational views of the inventive device in use, showing the position of the patient in dotted lines;

FIG. 14 is a partial view in perspective view of the base portion of the inventive device, with a stand-up platform;

DETAILED DESCRIPTION OF THE EMBODIMENT

Figure 1:
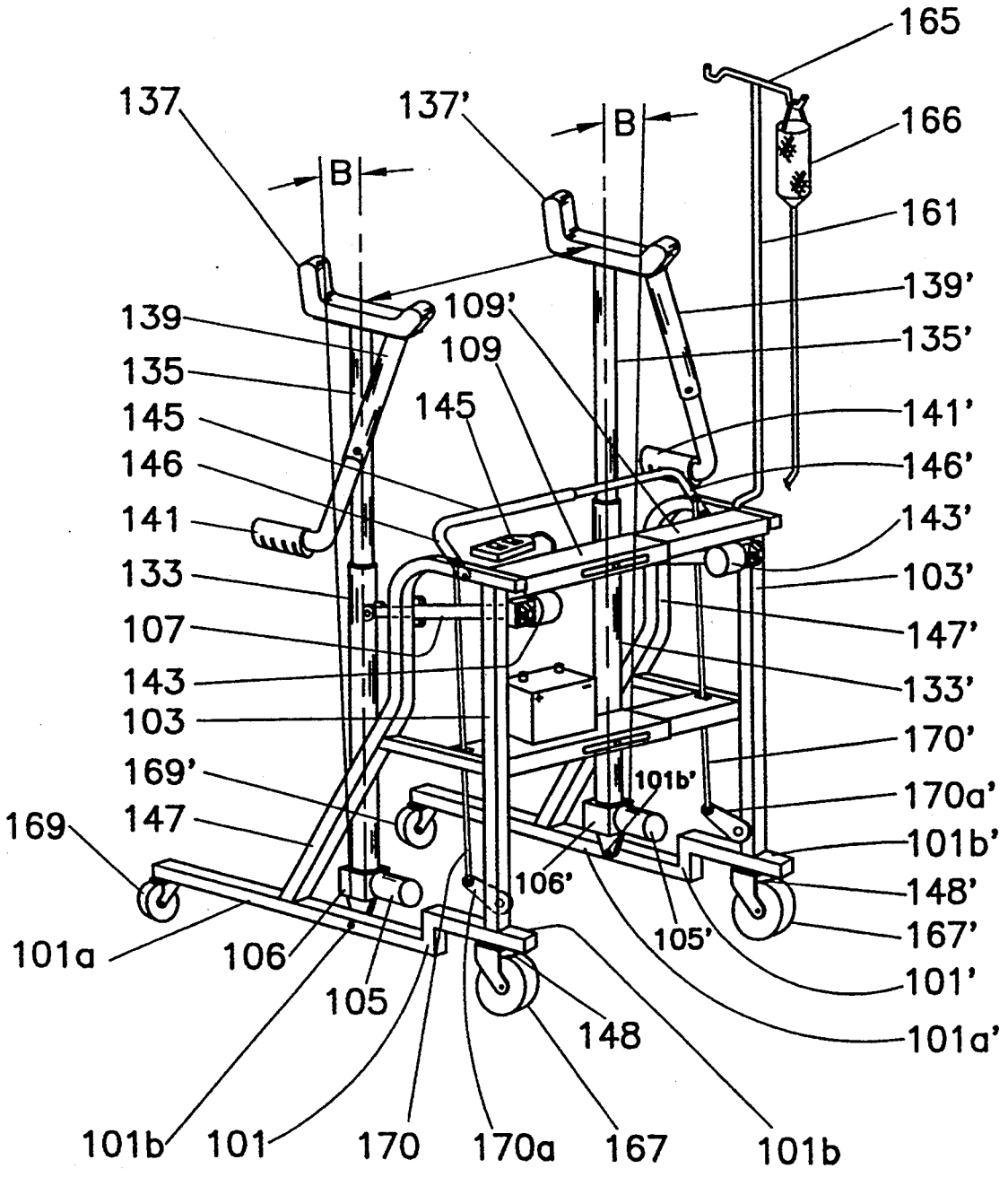
FIG. 1 is a simplified perspective view of the patient transfer walker device.
Figure 3:
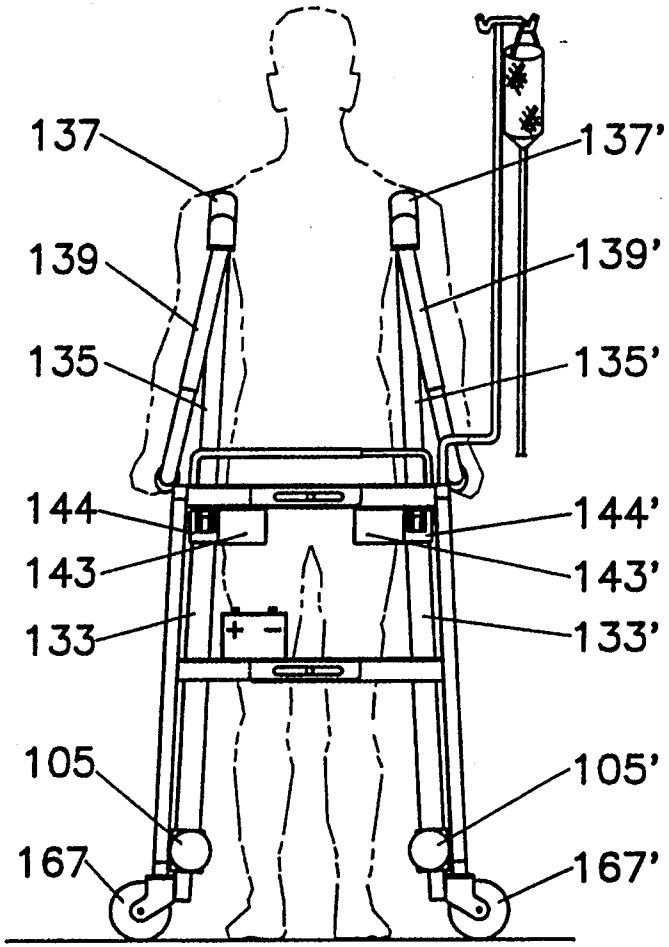
FIG. 3 is a front elevational view of the device.
Figure 2:
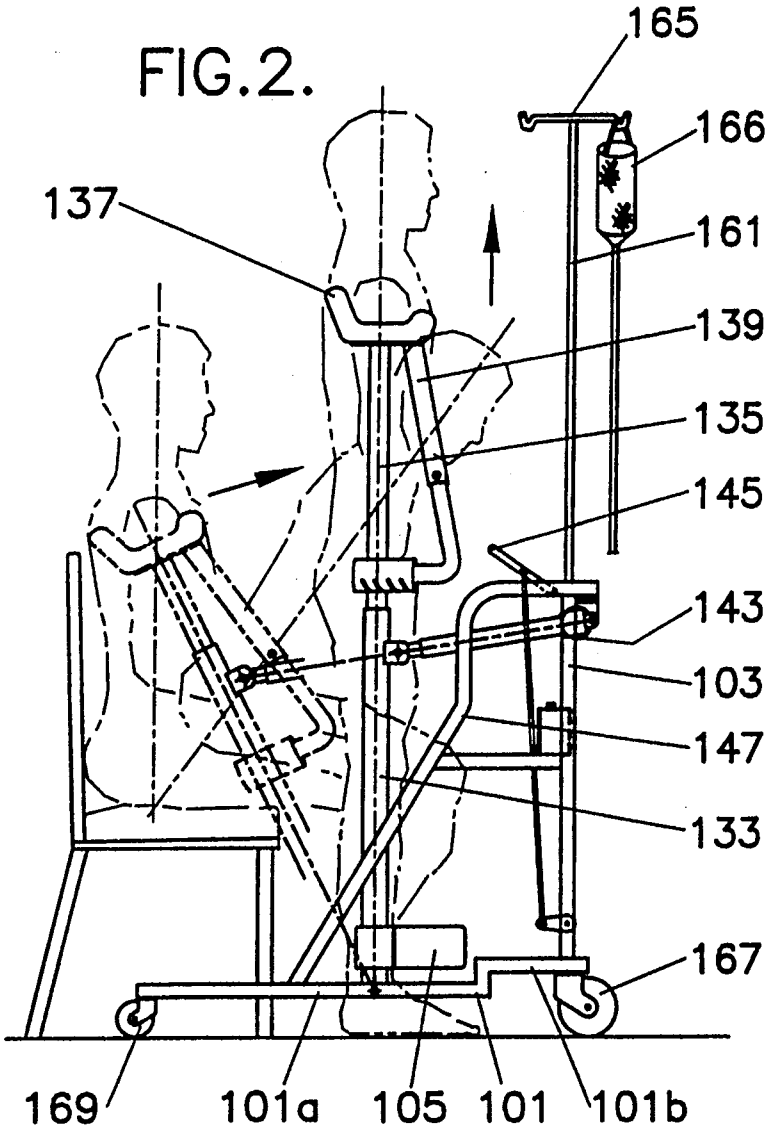
FIG. 2 is a side elevational view of the inventive device, showing in phantom dotted lines the patient in a sitting, intermediate and standing positions.

Turning now to the drawings, there will be seen in FIG. 1 an overall view of the inventive patient walker, adapted to cooperate with a handicapped person, or user, who in turn makes use of a chair or toilet to sit on, when needed.

The base of the patient walker includes a pair of base rails 101 and 101', which are juxtaposed with one another, and generally run in parallel with one another along a horizontal direction. A pair of first, or front non-movable posts 103 and 103' are attached to respective front portions of the base rails 101 and 101' and extend in a direction normally at right angles therewith.

Figure 4:
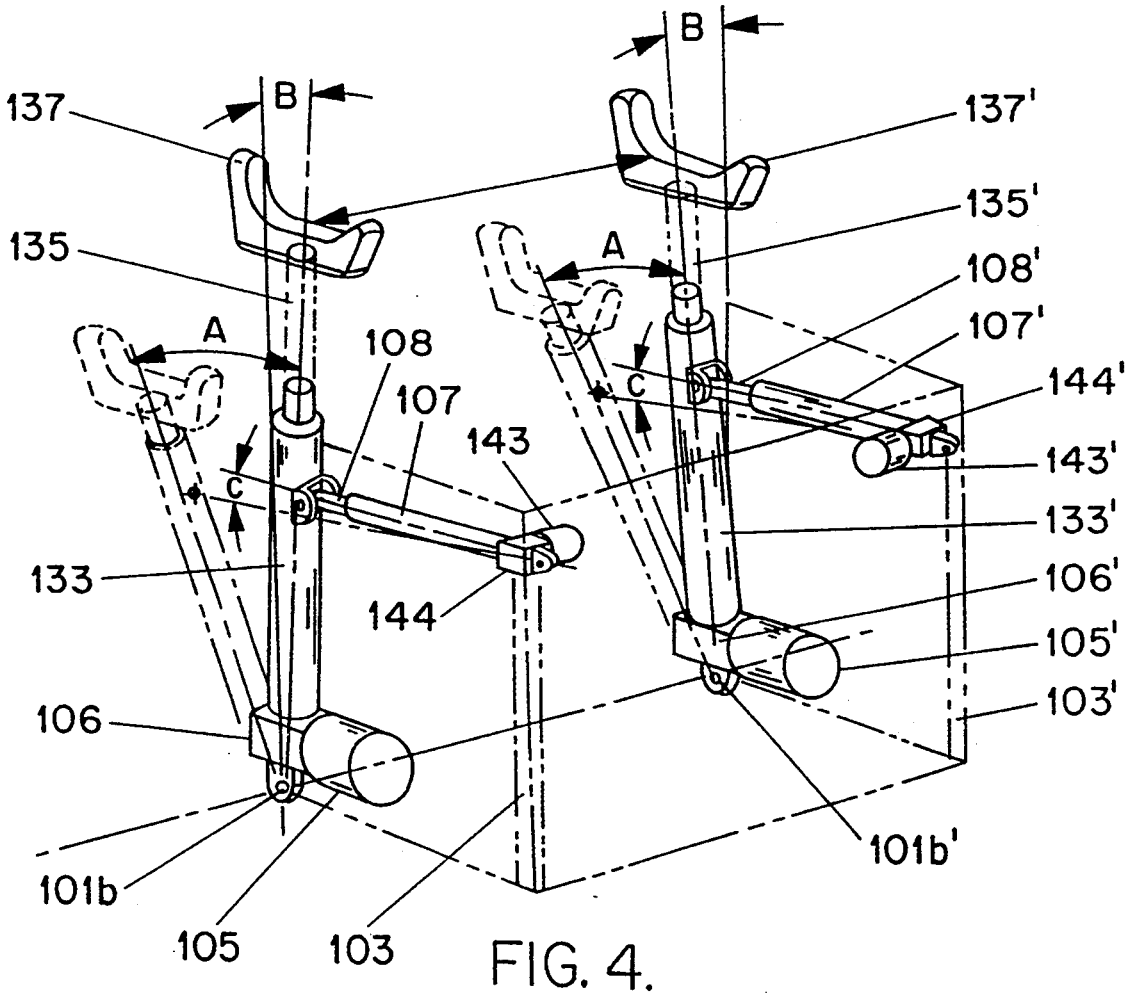
FIG. 4 is a close up perspective view of the lifting portion of the inventive device, showing in dotted lines the movement range of the arm-lifting portions thereof.
Figure 15:
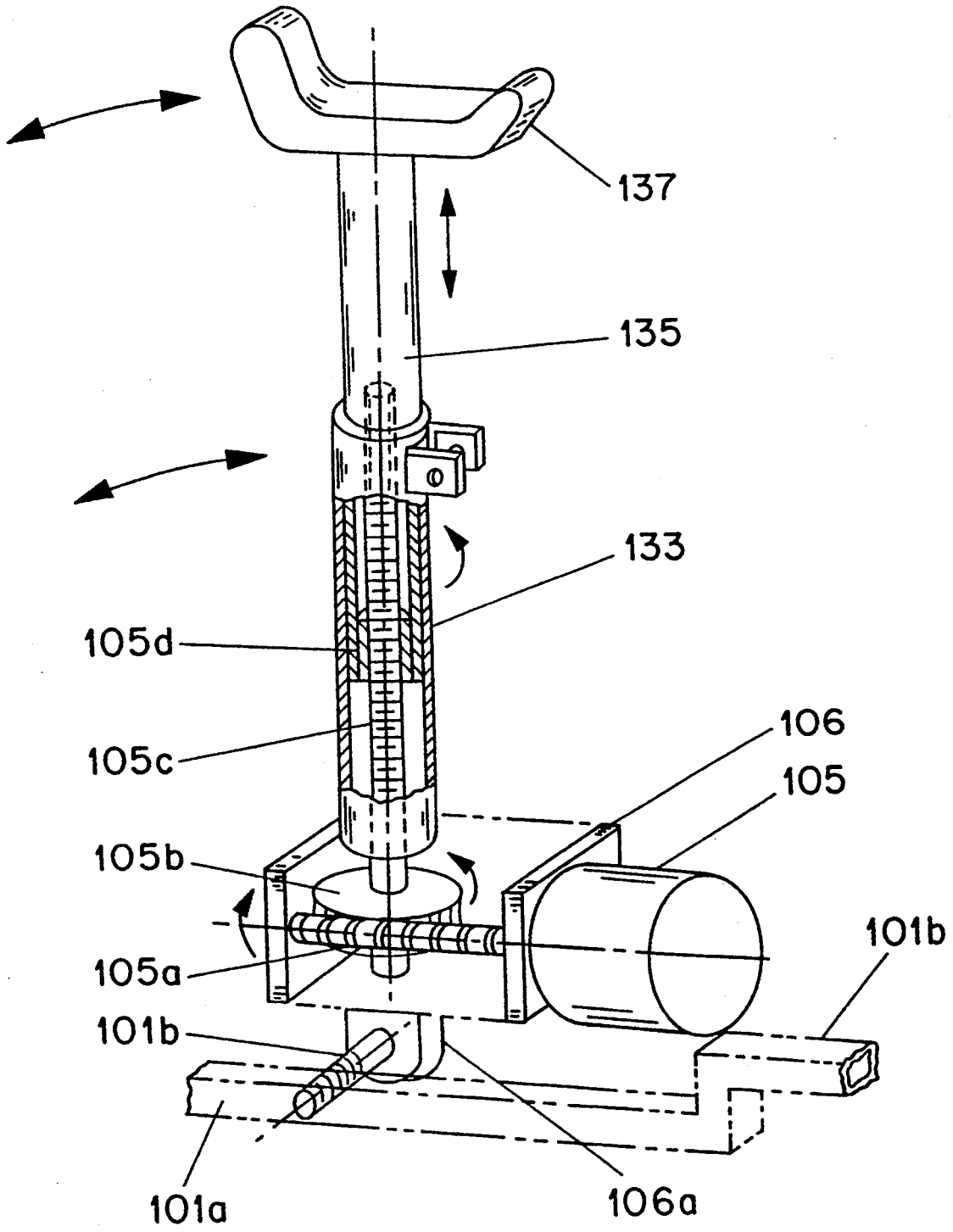
FIG. 15 is a perspective view of a first version of the vertical actuator, in partial cross-section.
Figure 16B:
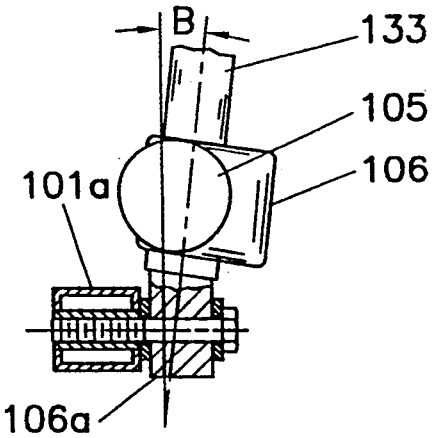
FIG. 16B is a cross sectional view of the movable attachment parts of the vertical actuator portion of the inventive device, as in FIG. 16, taken along lines 16B—16B of FIG. 16.
Figure 16A:
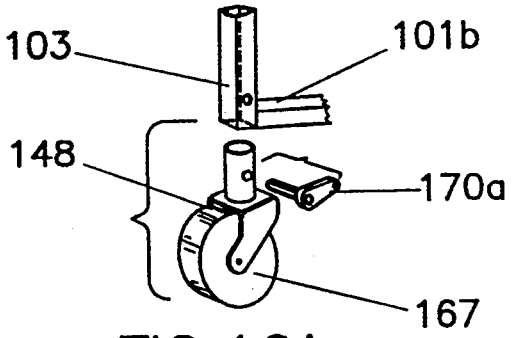
FIG. 16A is a perspective view of a caster assembly of the inventive device used in a manual pushing mode, and also showing the method of attaching a caster to the inventive device.
Figure 16:
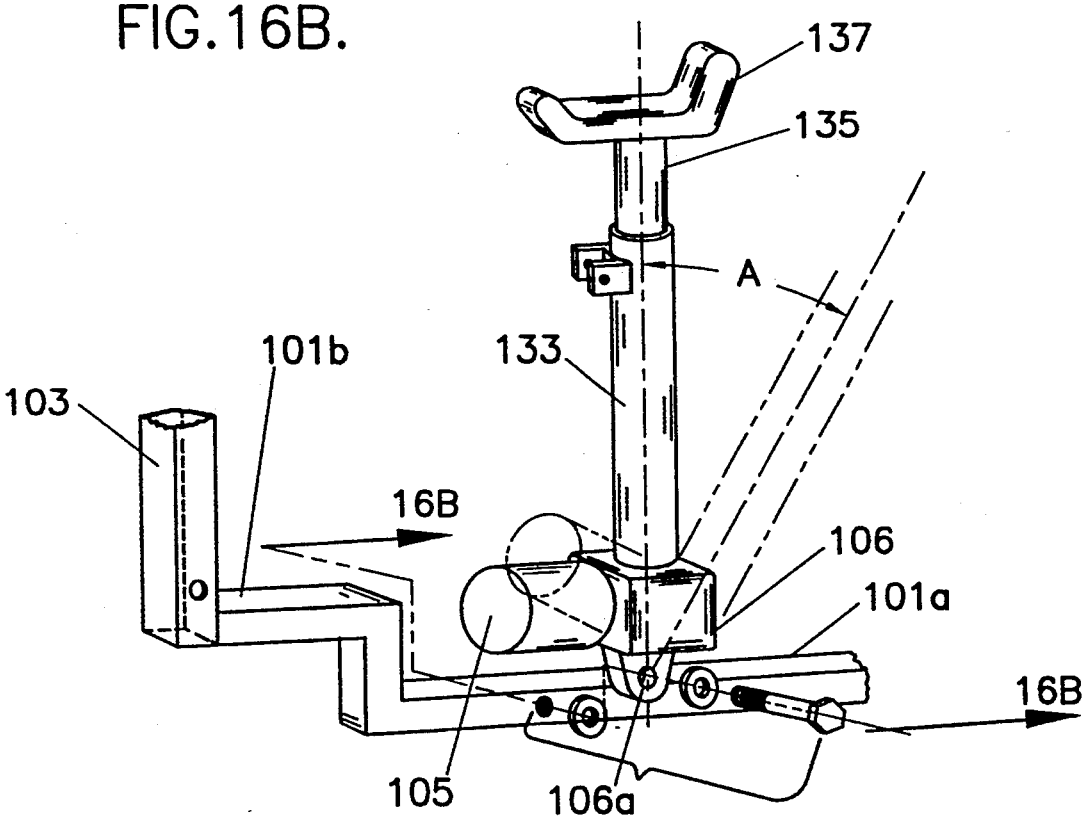
FIG. 16 is a close-up perspective view of the movable attachment parts of the vertical actuator portion of the inventive device in its first version.

As shown in FIGS. 1, 4 and 15, vertical movement is achieved by the raising or lowering of preferably padded crutch support pads 137, 137', for supporting a handicapped person under the armpits. Pads 137, 137' are attached at their respective undersides to a pair of movable longitudinally extending posts 135, 135' respectively.

As shown in FIGS. 4 and 15, movable posts 135, 135' move telescopically within a pair of longitudinally extending hollow lower second vertical posts 133, 133' by means of a first pair of motors 105 and 105' which are pivotably attached to first rotating output shafts 105*a*, which in turn rotate gears 105*b*, which gears 105*b* are rotatably attached to second rotating shafts, such as worm gear spindles 105*c*, within posts 133, 133'. Second shaft gear spindles 105*c* are threadably movable within posts 133, and cause the increase or decrease of the vertical movement of upper posts 135, 135' by means of the threading movement of spindles 105*c* within female annular threaded member 105*d* attached to the inside of upper telescoping posts 135, 135'.

The pair of hollow second posts 133, 133' are pivotally attached to lower portions 101*a*, 101*a* ' of base rails 101, 101' by pivotable means such as pins within clevis yokes or by bearings, so as to be tiltable with respect to base rails 101, 101'.

Respective lower portions 101*a* and 101*a'* of the base rails 101 and 101' are attached by conventional clevis yokes 10l*b*, 10l*b'* to rotatably energizable gear reduction means 106, 106' which are tiltably coupled to lower hollow second posts 133, 133' . Gear reduction means 106, 106', such as gear boxes, house therein output shafts 105*a*, meshing gear 105*b*, and the lower end of worm gear spindles 105*c*. Alternatively conventional bearings may be used.

Figures 17, 17A:
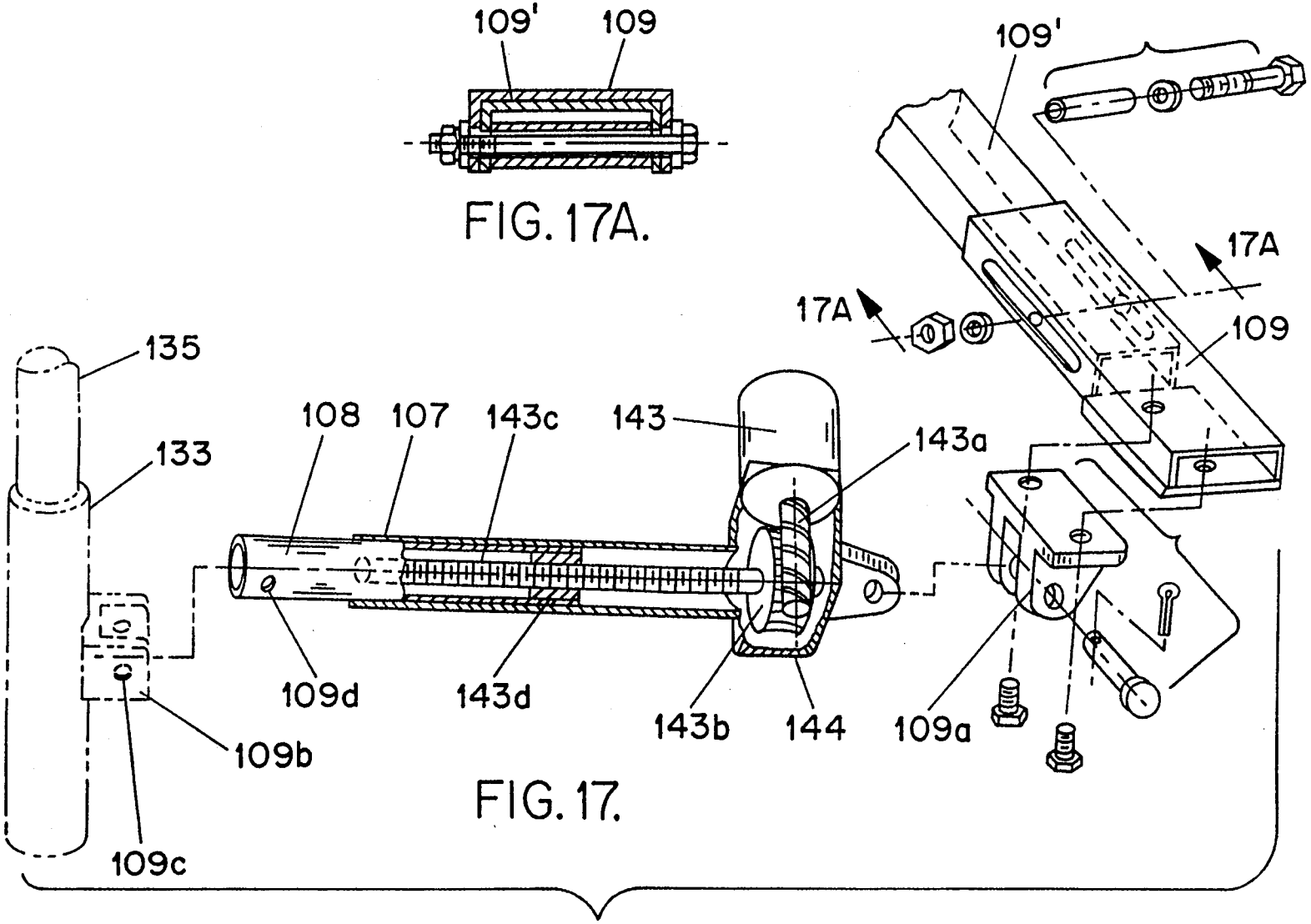
FIG. 17 is a close up perspective view of the horizontal actuator in the first version thereof.
FIG. 17A is a closeup cross sectional view taken along line 17A—17A of FIG. 17.
Figures 18, 18A:
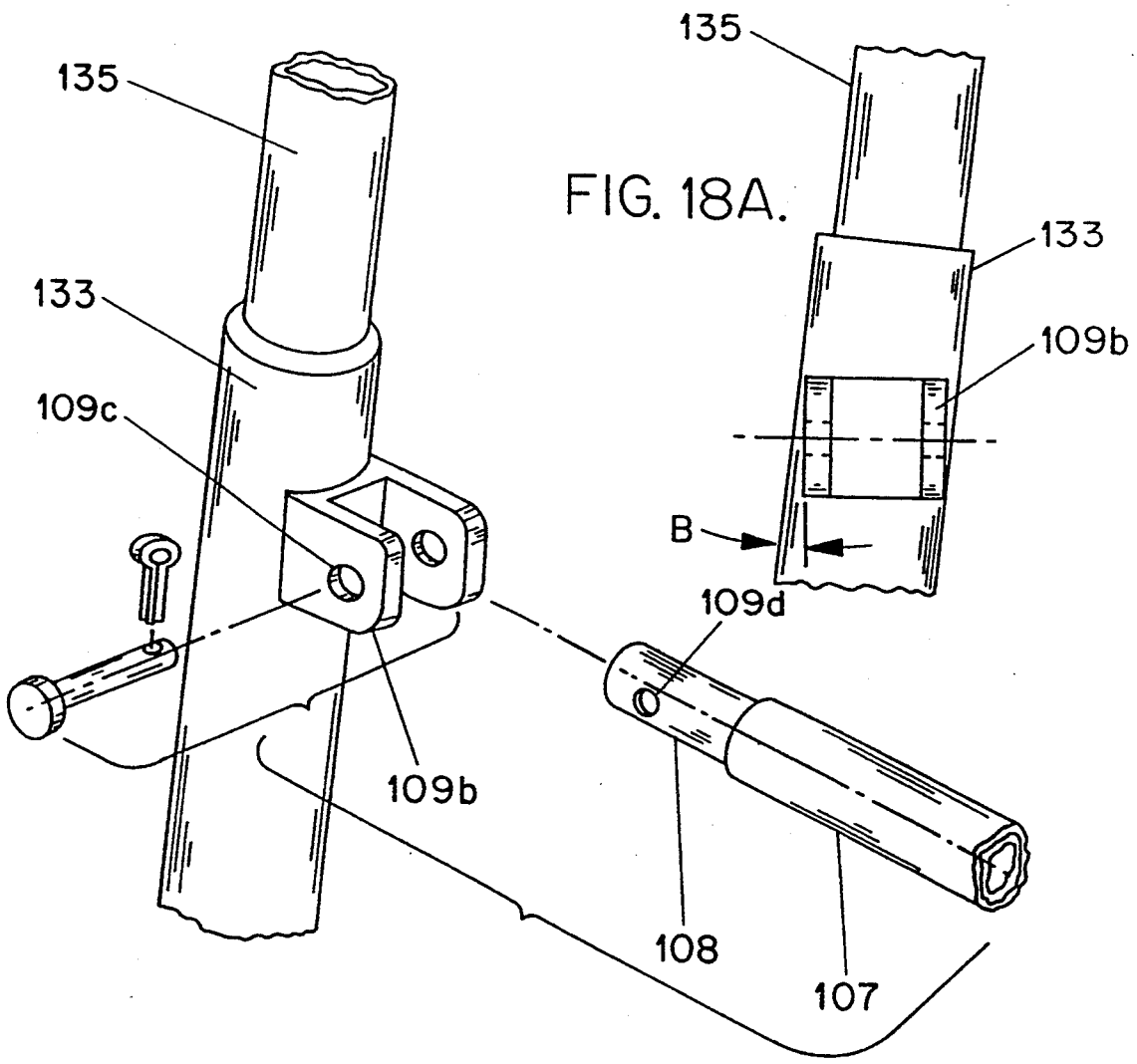
FIG. 18 is a closeup perspective view of a clevis yoke of the inventive device.
FIG. 18A is a closeup fragmentary front elevational partial view of an output shaft attachable to the clevis yoke as in FIG. 18.

As shown in FIGS. 4 and 17, clevis yokes 109*b* includes a collar having bores 109*c* in positional register with respective bore 109*d* within movable shaft 108, which urges hollow second post 133, upper post 135, and crutch support 137 outward off of a vertical post.

To actuate the vertical actuators, conventional ball-drive actuators have been selected, such as a model 85151 of the Motion Systems Corporation of New Jersey, using a 12 V. DC supply, the motor operating at a nominal speed of 6000 R.P.M., and having a gear step-down ratio of 10:1. For the horizontal actuators, conventional ball-drive actuators have been selected, such as model 85515, also of the Motion Systems Corporation of New Jersey, using again a 12 V. DC supply, the motor operating at a nominal speed of 7500 R.P.M., and a step-down ratio of 7.5:1.

Turning again to FIG. 1, wherein there is described separate horizontal 144, 144' and vertical 106, 106' actuator gear reduction means, it will be seen that a pair of length-adjustable levers 139 and 139' extend outwardly and generally downwardly from the crutch supports 137 and 137' respectively. The latter are preferably padded, and the levers 139 and 139' are bent rearwardly near lower ends thereof; a pair of easily gripable handles 141 and 141' are attached thereto, and extend rearwardly from the lower ends of the levers 139 and 139', respectively As best seen from FIGS. 1 and 4, horizontal movement is achieved by a second pair of longitudinal and sense-of-rotation changeable motors 143 and 143', respectively, which motors 143, 143' are attached to the first posts 103, 103' near their tops, respectively.

As shown in FIG. 4, the horizontal members 108, 108' move hollow second posts 133, 133' at an angle "A" off of the vertical such as 28°–30°. Such a movement outward of posts 133, 133' also results in the vertical displacment of horizontal members 107, 108 and 107', 108' downward by an angle "C" approximately 2°, off of their original horizontal alignment.

Furthermore, as also shown in FIG. 4, for the comfort of the handicapped person, hollow second posts 133, 133' are tilted inward from the vertical at an angle "B" approximately 3°, to simulate a person's general placement of crutches slightly inward at the top arm support level in conjunction with a slight outward placement of the conventional crutch bottoms on the ground.

The second pair of rotation-transmitting and gear reduction means 144, 144' for horizontal movement, which is similar to the first pair of rotation-transmitting and gear reduction means 106, 106' for vertical movement, is coupled to the second pair of motor means 143 and 143', respectively, near one of the ends thereof.

The components making up the second pair of rotation-transmitting and gear reduction means for horizontal movement are shown in FIG. 17, and are similar to those of the first pair of rotation-transmitting and gear reduction means for vertical movement of crutch support pads 137, 137'.

Horizontal movement is achieved by the inward and outward generally horizontal movement of movable posts 108, 108' respectively, which move telescopically within hollow generally horizontal posts 107, 107' by means of second pair of motors 143, 143' having chassis motors 143, 143' which are pivotably attached to rotating output shafts 143*a*, which in turn rotate gears 143*b*, which gears 143*b* are rotatably attached to second rotating shafts, such as worm gear spindles 143*c* within posts 107, 107'. Second rotating shafts, such as gear spindles 143*c* are threadably movable within posts 107, 107', to effect an increase or decrease of the length of shaft spindles 143*c*, so as to cause the horizontal movement of outer horizontal posts 108, 108' and inner, hollow horizontal posts 107, 107' by means of the threading movement of spindles 143*c* within female annular threaded member 143*d* attached to the inside of outer telescoping posts 108, 108'.

As shown in FIG. 15, respective lower portions 101*a* and 101*a'* of the base rails 101 and 101' are attached by bearings 106a to gear boxes 106, 106'.

Alternatively, as shown in FIG. 17 for the horizontal gear reduction means, gear boxes 144, 144', may be attached to top rails 109, 109' by conventional clevis yokes 109*a*.

However, as shown in FIG. 4, or to adjustable horizontal upper rails 109, 109', as shown in FIG. 17, either method of attachment can be used, such as vice versa, clevis yokes for the vertical actuators 106 or vice versa, bearings for the horizontal actuators 144.

In such cases the linking members, such as clevis yokes 109*a* or bearings 106*a*, the bearings 106*a* may be shaped slightly differently in any particular case, so as to match the different attachment regions of actuation gear boxes 106, 106' or 144, 144' to the patient transfer walker.

As has already been indicated, the base rails 101 and 101' have first lower portions 101*a* , and second higher portions 101*b*, and 101*b'*. As shown in FIG. 15, the respective lower portions 101*a* , and 101*a'* may carry bearings 106*a*, or may be attached by clevis yokes to gear boxes 106, 106'.

An operator-handlable switch 145 is connected to the motors 105, 105' and 143, 143' for separate adjustment of the height and inclination of the second posts 135 and 135', respectively, by selective choice of the sense of rotation and time duration of each of the pairs of motors 105, 105' and 143, 143', respectively, so that the handicapped person can move himself/herself between sitting and upright positions.

To enhance the sturdiness of the walker two brace structures 147 and 147' are joined with first ends thereof to respective first posts 103, 103' at their upper ends, and to the base rail portions 101*a*, 101*a'*, respectively, at their lower ends.

Figure 21:
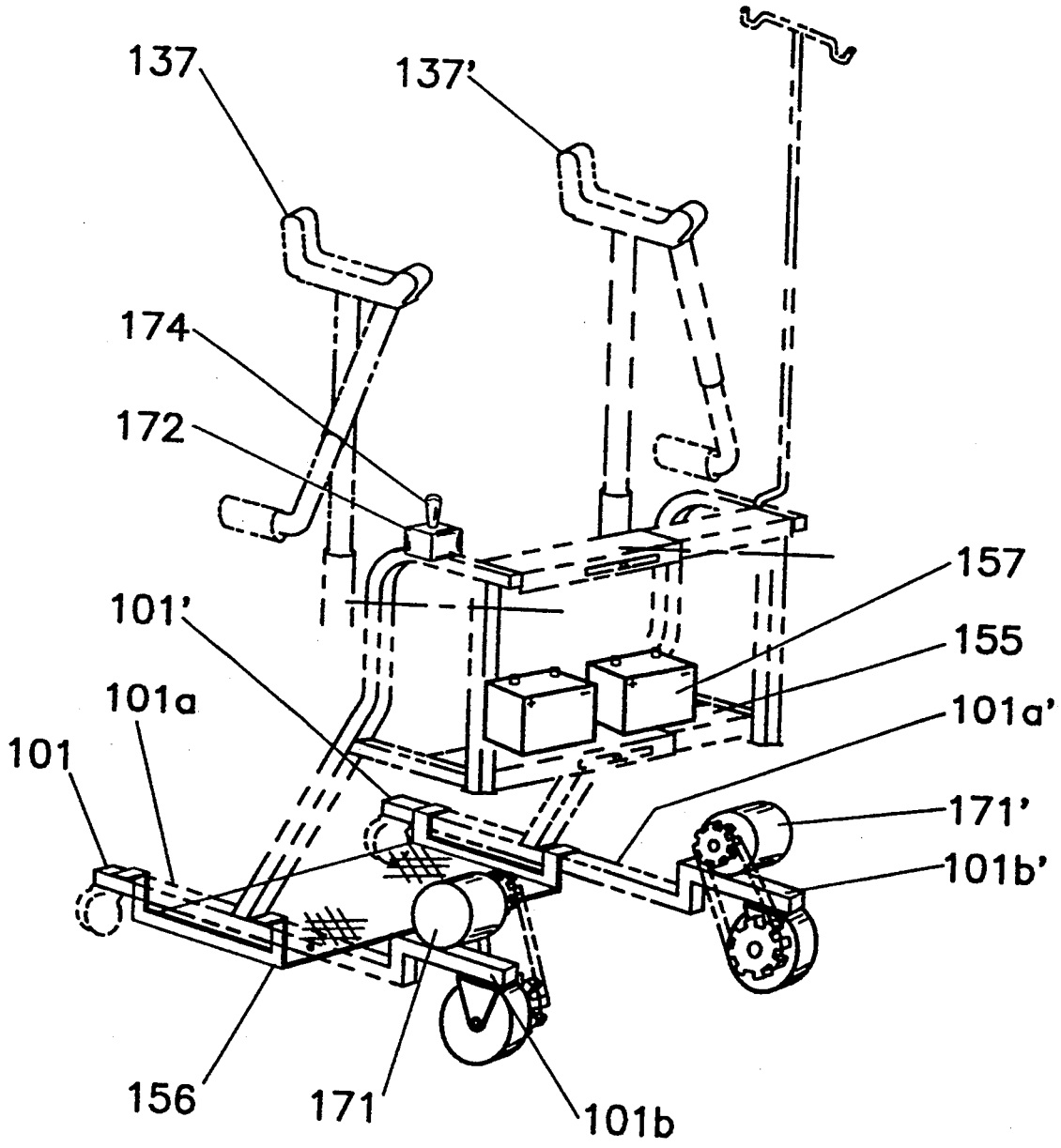
FIG. 21 is a perspective view of an alternate front drive self-propelled embodiment according to the present invention.

In case of an alternate self-propelled embodiment as shown in FIG. 21, a horizontally extending standing plate 155 is provided thereto, in parallel with a floor there below. The standing plate 155 is used to carry accessories, such as one or two accumulators 157.

For example, two such accumulators 157 would be used, if a motorized transport means, having a higher energy consumption than if only a manually operated walker were, in fact, to be used.

As further shown in FIG. 21, in a preferred embodiment a second lower horizontal extending plate 156 is provided parallel to the floor there below, for the handicapped person to stand thereon during transport.

Preferably, plates 155, 156, as well as top structural plate 109 are lengthwise adjustable or hingable at or near the centers thereof so as to be adjustable in size or foldable or movable inward, for folding the patient walker.

As shown in FIG. 1, an optional rod 165 is preferably fastened to a vertical bar 161 at one end thereof, and adapted to have an intravenous feeder 166 suspended therefrom.

As also shown in FIG. 1, two rollable casters 167, 167', and 169 169' are attached at respective front ends and rear ends to respective undersides of the base rails 101, 101', to make the walker easily movable upon the floor; the front castors 167, 167' have preferably a larger diameter than the rear castors 169, 169'.

Figure 20:
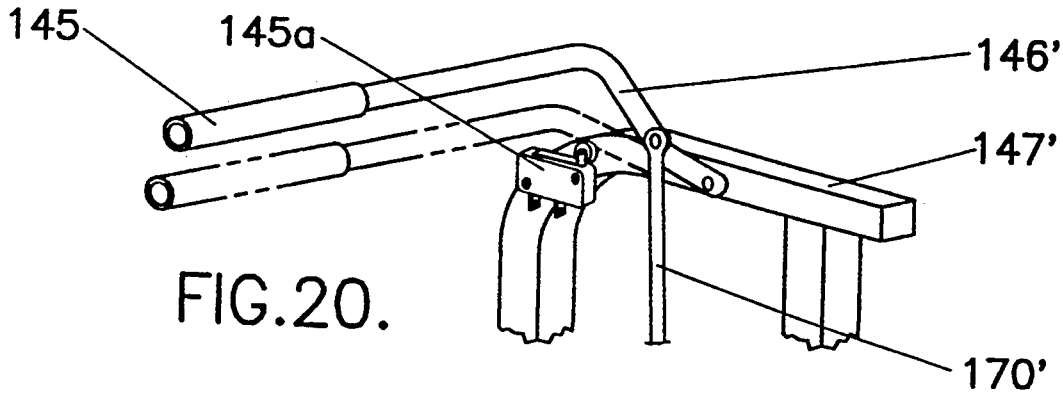
FIG. 20 is a close up view of the brake lock lever as in FIG. 19.
Figure 19:
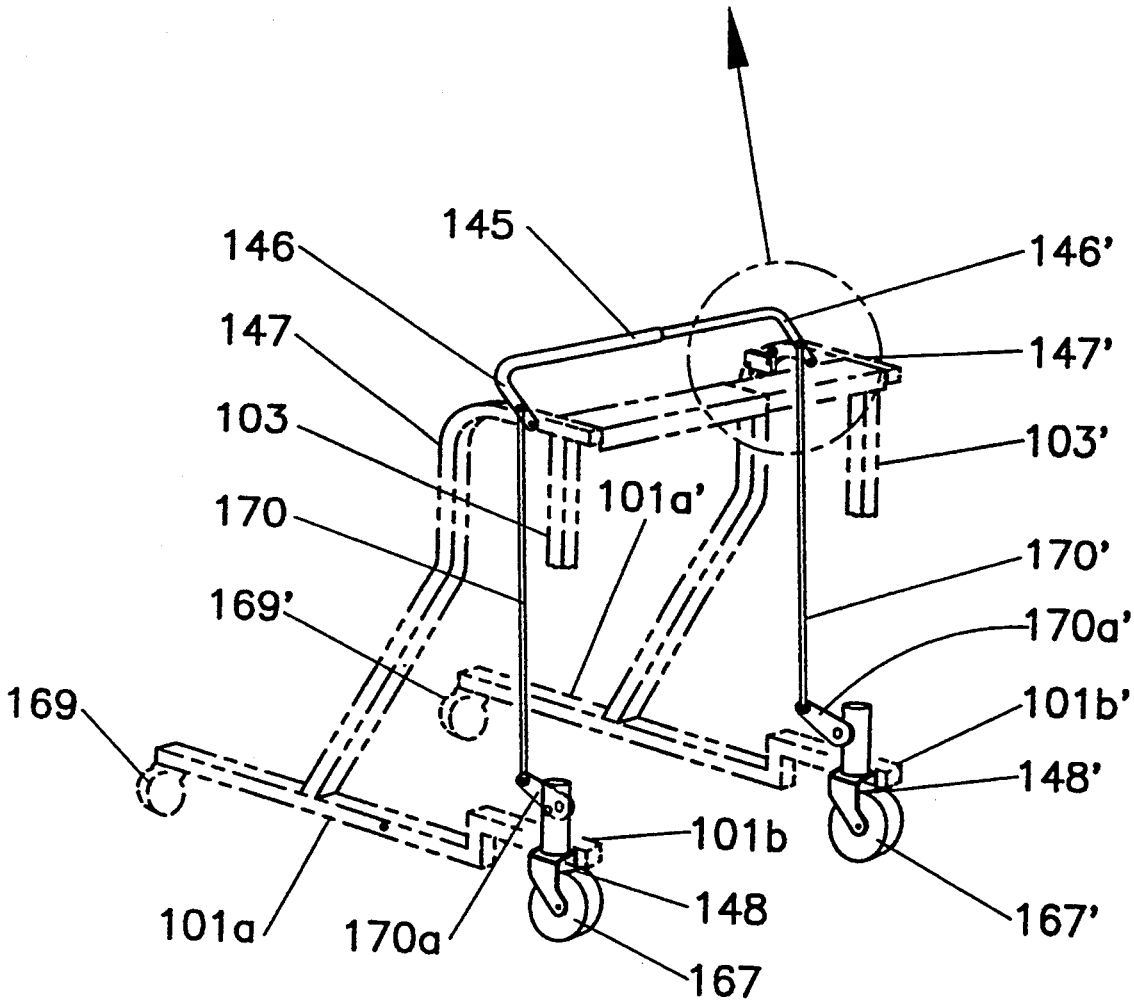
FIG. 19 is a perspective view of the brake lock lever of the present invention.

As shown in FIGS. 19 and 20, a brake lock lever 145 is approximately shaped in the form of an inverted "U" and has two short arms 146, 146', which are pivotally attached to the structures 147, 147' with their first or front ends, respectively.

Pivotable brakes 148, 148' are juxtaposed with both castors 167, 167', respectively, facing the front Linkage means 170, 170' for example, in the form of a cable, operatively connects each of the brakes 148, 148' with brake-lock levers 170*a* , 170*a'*, respectively, in order to tighten or loosen the brakes 148, 148'.

As shown in FIG. 20, there is also depicted safety lock switch 145*a* for brake handle 145, which serves to render the lifting vertical actuator motors 105, 105' and horizontal actuator motors 143, 143' inoperable when the brakes 148, 148' of the patient tranfer device are not in an operable position to stop the patient transfer device. Therefore, the patient lifting is only accomplished when brakes 148, 148' of the patient transfer device are applied.

As shown in FIG. 21, alternatively motorized transport means 171, 171', such as gear motors and drive components, can be attached to the base rails 101 and 101', together with guidance means 172 therefor, accessible to the handicapped person for guiding the motorized transport means 171, 171'. The guidance means 172 takes the form of a joystick 174. Preferably motorized transport means 171, 171' may be inactivated by a safety switch within guidance means 172.

Figure 22:
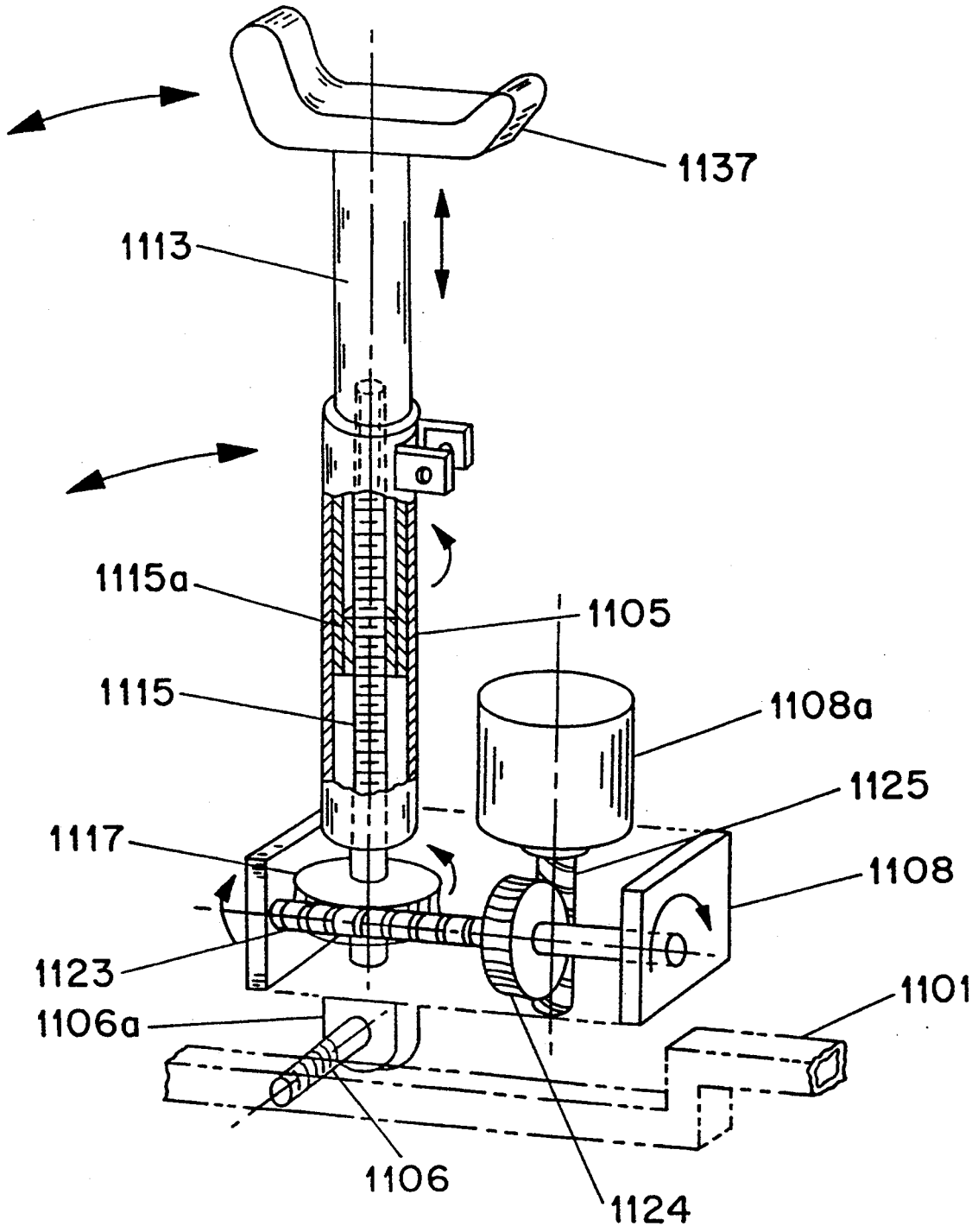
FIG. 22 is a close up view in partial section of an alternate embodiment with a double gear lifting actuator.

As shown in FIG. 22, in a further embodiment with a double gear reduction means in one unit for both horizontal and vertical movement, crutch supports 1137 are attached to telescopic movable post 1113, which is movable within hollow post 1105 having therein female threaded member 1115*a* in which threaded worm gear spindle 1115 moves up and down. Threaded worm gear spindle 1115 is attached to first gear 1117, which rotates by means of further rotating worm gear spindle 1123, which is actuated by further rotating gear 1124, which further rotating gear 1124 is actuated by second further worm gear spindle 1125 directly attached and energized by motor 1108*a*, which is disposed on gear box 1108. Horizontal movement is achieved by movement of the respective gears, so that bearing 1106*a* pivots about bearing pivot 1106, which is rotatably attached to base rails 1101.

Other modifications may be made to the patient transfer walker of the present invention, without departing from the spirit and scope of the present invention, as noted in the appended claims.

In summary, the patient transfer walker of the present invention includes a lifting mechanism which lifts a handicapped patient in a natural movement which closely simulates the natural upward and outward movement of a person getting up from and to a sitting position. In doing so, the present invention eliminates the uncomfortable hoisting and single lever lifting motions of the prior art devices, which lifts a handicapped person in unnatural, uncomfortable movements. In contrast, by selective choice of the sense of rotation and time duration of the pairs of telescoping posts supporting crutch armpit supports, the handicapped person can be moved comfortably between sitting and standing positions.

I claim:

1. A transfer walker for a handicapped person, comprising in combination a pair of base rails juxtaposed, and generally running in parallel with one another along a normally horizontal direction, each of said base rails having a front and a rear end, a pair of first posts normally extending upwardly, and in parallel with one another in a direction generally at right angles with a respective base rail direction, each of said pair of first posts being attached to a respective of said rails near respective front ends thereof, a pair of second posts normally extending upwardly, and in parallel with one another in a direction generally at right angles with a respective base rail direction, each of said pair of second posts being pivotally attached to a respective of said rails near respective rear ends thereof, so as to be tiltable, two pairs of length-adjustable and rotatably energizable gear reduction means, and rotatable and tiltable coupling means combined therewith, respectively, each of said length-adjustable and rotatably energizable gear reduction means and rotatable and tiltable coupling means combined therewith having respective output shafts, said output shafts of a first pair of said length-adjustable and rotatably energizable gear reduction means and rotatable and tiltable coupling means combined therewith running generally in parallel with one another, and being upright in an inoperative rest position thereof, and a pair of crutch supports having undersides, and being in operative contact with said output shafts of said first pair of said length-adjustable and rotatably energizable gear reduction and rotatable and tiltable coupling means combined therewith, respectively, on said undersides, being spaced at an adjustable distance from one another, and adapted to fit under the armpits of the handicapped person, a pair of length-adjustable levers extending outwardly and generally downwardly from locations near respective ends of said pair of crutch supports, said pair of levers being bent rearwardly near lower ends thereof, and a pair of easily gripable handles being attached thereto, and extending rearwardly from said lower ends of said levers, respectively, a second pair of said length-adjustable and rotatably energizable gear reduction means and rotatable and tiltable couplings means combined therewith being pivotally coupled near first ends thereof to top ends of said pair of first posts, respectively, and being pivotally and slidably coupled with the other ends thereof to said pair of hollow second posts, respectively, so as to be operative upon length adjustment thereof to effect a change of respective of said pairs of hollow second posts in a rearward direction, and back therefrom, up to a range of inclination of about 30° from the vertical, and operator-handlable switch means connected to respective of said first and second pairs of said length-adjustable and rotatably energizable gear reduction means and rotatable and tiltable coupling means combined therewith for separate adjustment of the height and inclination of said second pair of posts respectively, by selective choice of sense-of-rotation and time-duration of each of said pairs of length-adjustable and rotatably energizable gear reduction means and rotatable and tilting means combined therewith, respectively, whereby the handicapped person can move between sitting and upright positions.

2. The transfer walker as in claim 1, said two pairs of gear reduction means further comprising said output shafts engagable with meshing gears affixed thereto, respectively, so as to mesh with said second rotatable spindle shafts, respectively, each of said second posts being longitudinal and hollow, and inner longitudinal surface of each of said hollow longitudinal posts being formed as a female thread mating with respective of said threaded spindles, said threaded spindles being the outputs of said first pair of said length-adjustable and rotatably energizable gear reduction means and, rotatable tiltable coupling means combined therewith, respectively, and operating in a telescopic manner, upon said first motor means being activated, said hollow second posts being tiltable and said hollow second posts being pivotable about said base members, respectively, whereby an increase or decrease of the length of said spindles, respectively, can be effected in dependence upon a common direction of rotation of said motor means, a minimum height of said supports exceeding the height of said pair of first posts.

3. A walker according to claim 2, wherein said pair of bearings is mounted on respective of said base rails.

4. The transfer walker as in claim 1, further comprising an approximately U-shaped clevis yoke at least partly surrounding respective of said outer horizontal members, so as to be able to slide with respect thereto, and formed with a respective pair of aligned hole therein, in positional register with said outer horizontal members that when said outer horizontal member is inserted into said clevis yoke, the holes of said outer horizontal members being approximately aligned in positional register with said holes of said clevis yoke, and further comprising a pivot pin slidable into all of said aligned holes, so to align said pivot pin therewith, but leaving sufficient tolerance in said holes, so that said pivot pin is operatively tiltable about a center axis thereof, and said holes in said bracket having a diameter slightly exceeding a diameter of said pivot pin, so that said pivot pin is transversely tiltable in said clevis yoke, whereby a movement imparted to each said horizontal member is impressed on each said hollow second posts.

5. A walker according to claim 1, wherein each of said crutch supports is padded.

6. A walker according to claim 1, further comprising at least one plate extending horizontally, approximately in parallel with a floor therebelow.

7. A walker according to claim 6, wherein said rectangular plate is formed with a hinge therein, so as to be foldable.

8. A walker according to claim 1, further comprising a lengthwise adjustable bar joining said top portions of said first ends of respective of said first posts.

9. A walker according to claim 8, wherein said bar is provided with a hinge in the center and at extremes thereof so as to render said bar foldable.

10. A walker according to claim 8, further comprising an upwardly pointing rod fastened to said bar near one end thereof, and being formed with a top end adapted for suspending an intravenous feeder therefrom.

11. A walker according to claim 1, further comprising two rollable castors attached to an underside of each of said base rails near respective ends thereof, so that two of said castors are rear castors, the remaining two castors being front castors exceeding said rear castors in diameter thereof, all of said castors being small enough to pass under a normal bed or sofa.

12. A walker according to claim 11, further comprising a brake-lock lever approximately shaped in the form of an inverted "U", having two short arms the latter being pivotally attached to said structure near said first ends of thereof, a pivotable brake being juxtaposed with each of said castors facing the front, and linkage means operatively connecting each of said brakes with said brake-lock lever for tightening or loosening each of said brakes, respectively.

13. A walker according to claim 1, further comprising motorized transport means attached to said base rails, and guidance means therefor accessible to the handicapped person, for guiding said motorized transport means.

14. A walker according to claim 13, wherein said guidance means includes a joystick.

15. A walker according to claim 13, further comprising safety switch means for inactivating said pairs of motor means.

16. A walker according to claim 1, wherein said first pair of posts is adapted to extend upwardly to a level normally near the waist portion of the handicapped person, said walker being adapted with a front end thereof to slide over a toilet, and wherein said transverse bars are pivotably attached near one of the ends thereof to said first posts near the respective top portions thereof, said latter top portions being also joined by two separate structures, respectively, to respective of said rails, at respective locations relatively close to rear portions of the latter.

* * * * *